US009553406B2

(12) United States Patent
Wu et al.

(10) Patent No.: US 9,553,406 B2
(45) Date of Patent: Jan. 24, 2017

(54) WIRE CONNECTION TERMINAL STRUCTURE WITH WIRE GUIDANCE FEATURE

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Shao-Te Chang, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 14/877,105

(22) Filed: Oct. 7, 2015

(65) Prior Publication Data

US 2016/0134054 A1 May 12, 2016

(30) Foreign Application Priority Data

Nov. 6, 2014 (TW) ..... 103219704 U

(51) Int. Cl.

| | |
|---|---|
| ***H01R 13/64*** | (2006.01) |
| ***H01R 13/633*** | (2006.01) |
| ***H01R 4/48*** | (2006.01) |
| ***H01R 9/24*** | (2006.01) |
| *H01R 12/57* | (2011.01) |

(52) U.S. Cl.

CPC ..... *H01R 13/633* (2013.01); *H01R 4/4836* (2013.01); *H01R 9/2416* (2013.01); *H01R 9/2491* (2013.01); *H01R 12/57* (2013.01)

(58) Field of Classification Search

CPC ..... H01R 13/52; H01R 4/4827

USPC ..... 439/439, 441, 828, 835, 374, 381

See application file for complete search history.

(56) References Cited

U.S. PATENT DOCUMENTS

| | | | | |
|---|---|---|---|---|
| 3,246,283 A * | 4/1966 | Huska | H01R 9/26 | 439/716 |
| 5,454,730 A * | 10/1995 | Tozuka | H01R 4/4818 | 439/438 |
| 5,588,880 A * | 12/1996 | Wood | H01R 4/38 | 439/709 |
| 5,650,581 A * | 7/1997 | Sigrist | G10H 1/0058 | 439/381 |
| 6,682,364 B2 * | 1/2004 | Cisey | H01R 9/2666 | 439/441 |
| 7,234,959 B2 * | 6/2007 | Hsieh | G06F 1/1605 | 439/374 |

(Continued)

*Primary Examiner* — Neil Abrams

(74) *Attorney, Agent, or Firm* — Rosenberg, Klein & Lee

(57) ABSTRACT

A wire connection terminal structure includes a seat body and a conductive clip disposed therein. One end of the seat body has an extending side and a recessed side and a slope formed between the extending side and the recessed side. The conductive clip has a holding mouth. The slope is formed with a wire plug-in opening aligned with the holding mouth. A wire plug-in protection wall is formed on an edge of the recessed side. The wire plug-in protection wall protrudes in a direction as an extending direction of the extending side. The slope and the wire plug-in protection wall define a recessed configuration on the end of the seat body. The wire plug-in protection wall on the outer edge of the wire plug-in opening provides a shielding and guidance effect so that the conductive wire can be easily aimed at and plugged into the wire plug-in opening.

9 Claims, 5 Drawing Sheets

(56) References Cited

U.S. PATENT DOCUMENTS

| | | | | |
|---|---|---|---|---|
| 7,425,141 | B2 * | 9/2008 | Kanayama | G06F 1/1616 361/679.41 |
| D598,855 | S * | 8/2009 | Stromiedel | D13/133 |
| 8,113,858 | B1 * | 2/2012 | Chiang | H01R 4/4845 439/188 |
| 8,430,683 | B2 * | 4/2013 | Kurakagi | H01R 13/631 439/374 |
| 8,591,271 | B2 * | 11/2013 | Bies | H01R 4/4836 439/725 |
| 8,882,533 | B2 * | 11/2014 | Brandberg | H01R 13/193 439/441 |
| 8,908,371 | B2 * | 12/2014 | Ariga | H05K 5/0026 361/679.55 |
| 9,209,530 | B2 * | 12/2015 | Gassauer | H01R 4/4836 |
| 9,263,822 | B2 * | 2/2016 | Wu | H01R 13/2407 |
| D754,068 | S * | 4/2016 | Wu | D13/133 |
| D754,070 | S * | 4/2016 | Wu | D13/133 |
| 9,385,443 | B2 * | 7/2016 | Moser | H01R 4/4836 |
| 9,444,155 | B2 * | 9/2016 | Chen | H01R 4/48 |
| 9,466,894 | B2 * | 10/2016 | Wu | H01R 4/4836 |
| 2003/0139083 | A1 * | 7/2003 | Huang | H01R 13/6315 439/374 |
| 2003/0220009 | A1 * | 11/2003 | Takeguchi | H01R 12/7005 439/374 |
| 2016/0134054 | A1 * | 5/2016 | Wu | H01R 4/4836 439/660 |

* cited by examiner

WIRE CONNECTION TERMINAL STRUCTURE WITH WIRE GUIDANCE FEATURE

BACKGROUND OF THE INVENTION

1. Field of the Invention

The present invention relates generally to an improved wire connection terminal structure, and more particularly to a wire connection terminal structure having a seat body for an LED to plug in. The seat body is formed with a wire plug-in opening. The upper and lower sides of the wire plug-in opening of the seat body provide shielding, protection and guiding effects for the terminal of the external conductive wire. One end of the seat body has an extending side and a recessed side and a slope formed between the extending side and the recessed side. A wire plug-in protection wall is formed on an edge of the recessed side.

2. Description of the Related Art

A wire connection terminal is also referred to as a connector. The wire connection terminal is mainly used to connect the metal conductive wires (commonly referred to as electrical wire) between electronic components or connect the conductive wires between an electronic component and a circuit board. Also, the conductive contact pin of the electronic component can be plugged into the wire connection terminal as a socket of the electronic component. The electronic components include resistors, capacitors, inductors, LED, transformers, liquid crystal panels, touch panels, etc. Accordingly, the wire connection terminal serves to transmit power or electronic signals to facilitate installation and arrangement of the internal circuit boards and electronic components of the electronic product or apparatus.

Currently, there are various wire connection terminals on the market. In general, a conventional wire connection terminal has an insulation seat body and multiple conductive clips enclosed in the insulation seat body. The conductive clip is made of conductive metal material and has several elastic holding arms for holding the conductive wire or contact pin of an external electronic component. The conductive clip also has several soldering legs exposed to outer side of the seat body. The soldering legs of the conductive clip are soldered on a circuit board, whereby the seat body of the wire connection terminal is disposed in the electronic product or apparatus along with the circuit board. In addition, the seat body has a wire plug-in opening for the conductive wire or the contact pin of the external electronic component to plug into the seat body to be held in the holding mouth of the elastic holding arms. Also, in order to conveniently extract the conductive wire or the contact pin of the electronic component out of the holding mouth of the conductive clip of the wire connection terminal to replace the circuit board or electronic component and service the electronic product or apparatus, the conventional wire connection terminal generally has a structure for opening the holding mouth of the conductive clip.

The seat body of the wire connection terminal is generally fixed inside the electronic product or apparatus. Therefore, when it is desired to quickly replace the internal circuit board or electronic component of the electronic product or apparatus in precondition that the electronic product or apparatus is not disassembled to a great extent, an operator needs to extend his hand into the electronic product or apparatus to find the position of the seat body of the wire connection terminal by way of touch and extract the conductive wire or the contact pin of the original electronic component out of the wire plug-in opening of the seat body.

Then, in a touch manner, the operator can plug the conductive wire or the contact pin of the substitutive electronic component into the wire plug-in opening of the seat body.

However, the seat body of the conventional wire connection terminal generally has a rectangular and regular configuration. Therefore, it is hard for the operator to identify the position of the wire plug-in opening of the seat body by way of barehanded touch. Even if the operator touches and finds the position of the wire plug-in opening, it is still uneasy for the operator to aim the conductive wire or the contact pin of the substitutive electronic component at the wire plug-in opening of the seat body and plug the conductive wire or the contact pin into the wire plug-in opening. As a result, the conductive wire or the contact pin is quite often pressed against the outer wall of the seat body along the outer edge of the wire plug-in opening and bent or twisted. Moreover, the conductive wire or the contact pin is apt to deviate from the wire plug-in opening.

This leads to inconvenience in use of the wire connection terminal. Moreover, currently, there is a trend to miniaturize the volume of the wire connection terminal. This makes the above problem become more serious.

SUMMARY OF THE INVENTION

It is therefore a primary object of the present invention to provide an improved wire connection terminal structure. The wire connection terminal structure has a seat body formed with a wire plug-in opening. The upper and lower sides of the wire plug-in opening of the seat body provide shielding, protection and guiding effects for the terminal of the external conductive wire. This overcomes the problem of the conventional wire connection terminal that the seat body generally has a rectangular and regular configuration so that it is hard for an operator to identify the position of the wire plug-in opening of the seat body by way of barehanded touch. Also, the present invention eliminates the shortcoming of the conventional wire connection terminal that it is uneasy for the operator to aim the conductive wire or the contact pin of the electronic component at the wire plug-in opening of the seat body and plug the conductive wire or the contact pin into the wire plug-in opening so that it is inconvenient to use the conventional wire connection terminal.

To achieve the above and other objects, the wire connection terminal structure of the present invention includes a seat body and a conductive clip disposed in the seat body. One end of the seat body has an extending side and a recessed side and a slope formed between the extending side and the recessed side. The conductive clip has a holding mouth. The slope is formed with a wire plug-in opening in alignment with the holding mouth. A wire plug-in protection wall is formed on an edge of the recessed side of the slope. The wire plug-in protection wall protrudes from the edge in a direction as an extending direction of the extending side. The extending side of the slope and the wire plug-in protection wall together define a recessed configuration on the end of the seat body.

According to the above arrangement, when it is desired to quickly replace an internal circuit board or electronic component of an electronic product or apparatus in precondition that the electronic product or apparatus is not disassembled to a great extent, an operator can extend his hand into the electronic product or apparatus to touch and quickly find the wire plug-in protection wall and immediately identify the position of the wire plug-in opening of the seat body. Then, the conductive wire or the contact pin of the original electronic component can be quickly extracted out of the wire plug-in opening. Thereafter, in a touch manner, the terminal of the conductive wire or the contact pin of the substitutive electronic component is quickly moved to a positioned nearby to the wire plug-in protection wall of the seat body and plugged into the seat body. The wire plug-in protection wall on the outer edge of the wire plug-in opening provides a shielding effect so that the terminal of the conductive wire or the contact pin of the substitutive electronic component can be very easily and quickly plugged into the wire plug-in opening.

Even if the terminal of the conductive wire or the contact pin of the substitutive electronic component is plugged onto the slope by error, the slope can still guide the terminal of the conductive wire or the contact pin to move toward the wire plug-in protection wall. After the terminal of the conductive wire or the contact pin is moved to reach the wire plug-in opening, the terminal of the conductive wire or the contact pin can be easily plugged into the wire plug-in opening. Accordingly, the terminal of the conductive wire or the contact pin of the electronic component is prevented from slid away from the wire plug-in opening. In the case that the terminal of the conductive wire or the contact pin of the electronic component is plugged into the wire plug-in opening by an excessively large angle and the terminal of the conductive wire or the contact pin is pressed against the outer edge of the wire plug-in opening to cause bending or twisting of the terminal of the conductive wire or the contact pin. The wire plug-in protection wall serves to prevent the terminal of the conductive wire or the contact pin from being greatly deformed. Therefore, even if the terminal of the conductive wire or the contact pin is slightly bent, the terminal of the conductive wire or the contact pin can be still protected and guided to plug into the wire plug-in opening.

Accordingly, in the present invention, the upper and lower sides of the wire plug-in opening of the seat body provide shielding, protection and guiding effects for the terminal of the conductive wire or the contact pin to be plugged into the wire plug-in opening. This enables the terminal of the external conductive wire or the contact pin to be aimed at and plugged into the wire plug-in opening. Also, when plugged into the wire plug-in opening, the terminal of the conductive wire or the contact pin is prevented from being twisted or deviated from the wire plug-in opening. Therefore, the use of the wire connection terminal structure is facilitated.

In the above wire connect ion terminal structure, the conductive clip has at least one soldering leg exposed to a bottom face of the seat body. The slope is connected between a top face and the bottom face of the seat body. The slope has an edge inclined to the other end of the seat body and connected with the top face of the seat body. Accordingly, the terminal of the conductive wire or the contact pin can be guided to move toward the wire plug-in protection wall. During the move of the terminal of the conductive wire or the contact pin, the terminal of the conductive wire or the contact pin is easy to reach the wire plug-in opening and plug into the wire plug-in opening.

In the above wire connection terminal structure, the conductive clip has a force application section for driving the conductive clip to open/close the holding mouth. The top face of the seat body is formed with a perforation corresponding to the force application section. A pushbutton is disposed in the perforation for driving the force application section. Accordingly, an operator can press the pushbutton to drive the force application section so as to open the holding mouth of the conductive clip. Thereafter, the conductive wire or the contact pin of the electronic component can be quickly extracted out of the wire plug-in opening.

In the above wire connection terminal structure, there are a multiplicity of conductive clips, wire plug-in openings, perforations and pushbuttons. The conductive clips are side by side arranged in the seat body. The wire plug-in protection wall extends between two sides of the seat body to provide protection and guiding effects on the same side of the wire plug-in openings. Alternatively, there are a multiplicity of conductive clips, wire plug-in openings, perforations, pushbuttons and wire plug-in protection walls. The conductive clips are side by side arranged in the seat body. A middle partitioning wall is formed between two adjacent wire plug-in openings. A recessed section is formed between two adjacent wire plug-in protection walls. The middle partitioning wall is positioned between the recessed section and the slope.

The present invention can be best understood through the following description and accompanying drawings, wherein:

DETAILED DESCRIPTION OF THE PREFERRED EMBODIMENTS

Figure 1:
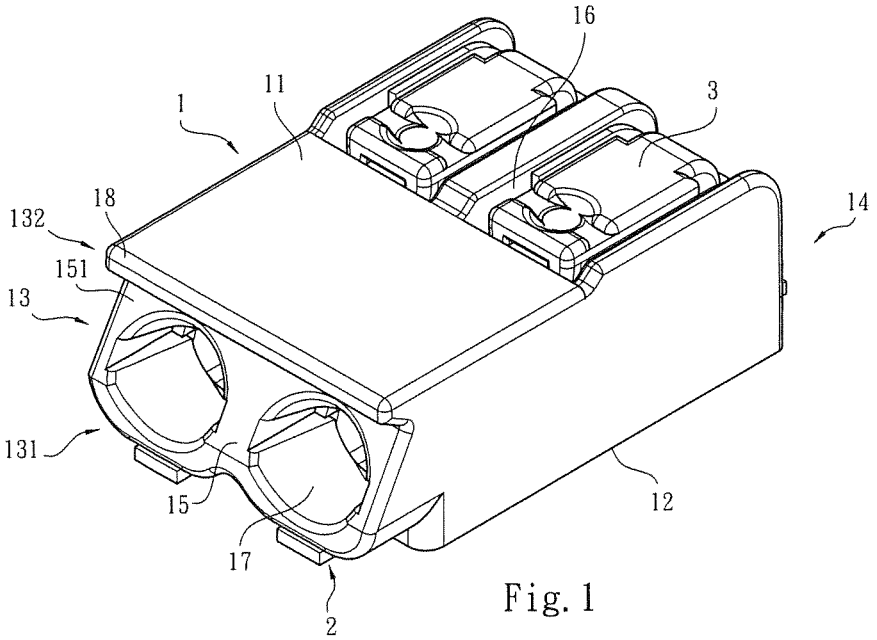
FIG. 1 is a perspective assembled view of the present invention.
Figure 2:
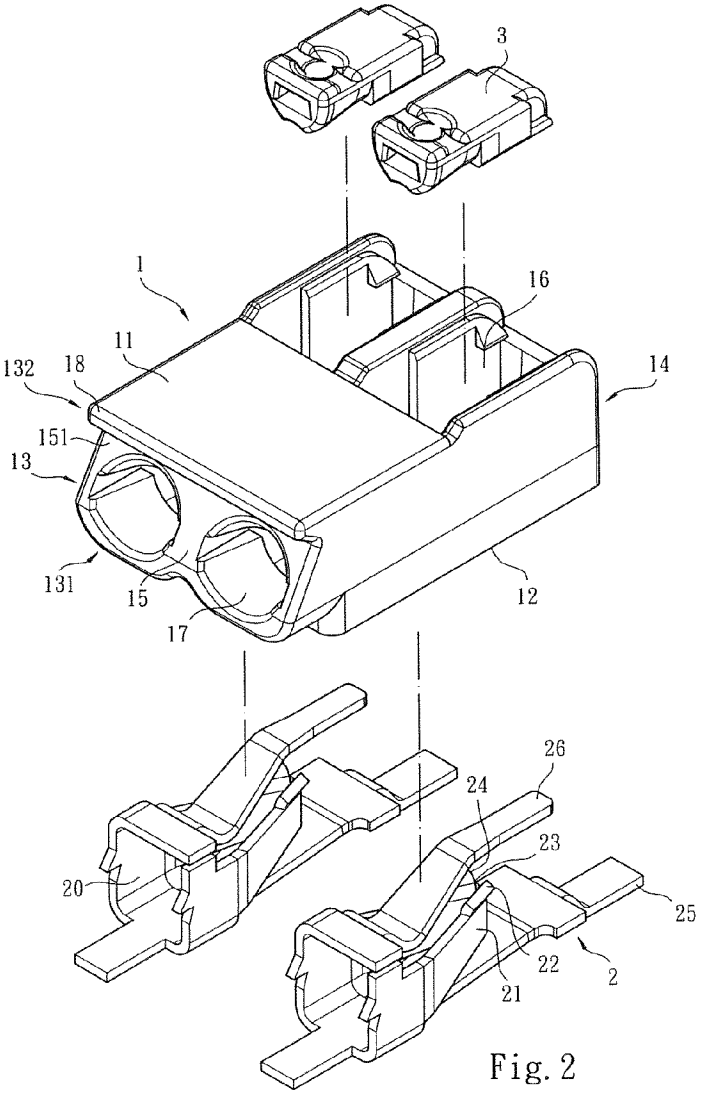
FIG. 2 is a perspective exploded view of the present invention according to FIG. 1.

Please refer to FIGS. 1 and 2. FIG. 1 is a perspective assembled view of the present invention. FIG. 2 is a perspective exploded view of the present invention according to FIG. 1. The wire connection terminal structure of the present invention includes a seat body 1 and a conductive clip 2 disposed in the seat body 1. The seat body 1 has a top face 11 and a bottom face 12 and a front end 13 and a rear end 14. The front end 13 of the seat body 1 has an extending side 131 and a recessed side 132 and a slope 15 formed between the extending side 131 and the recessed side 132. The slope 15 is connected between the top face 11 and bottom face 12 of the seat body 1. The slope 15 has an edge 151 inclined to the recessed side 132 of the seat body 1 is connected with the top face 11 of the seat body 1.

Figure 3:
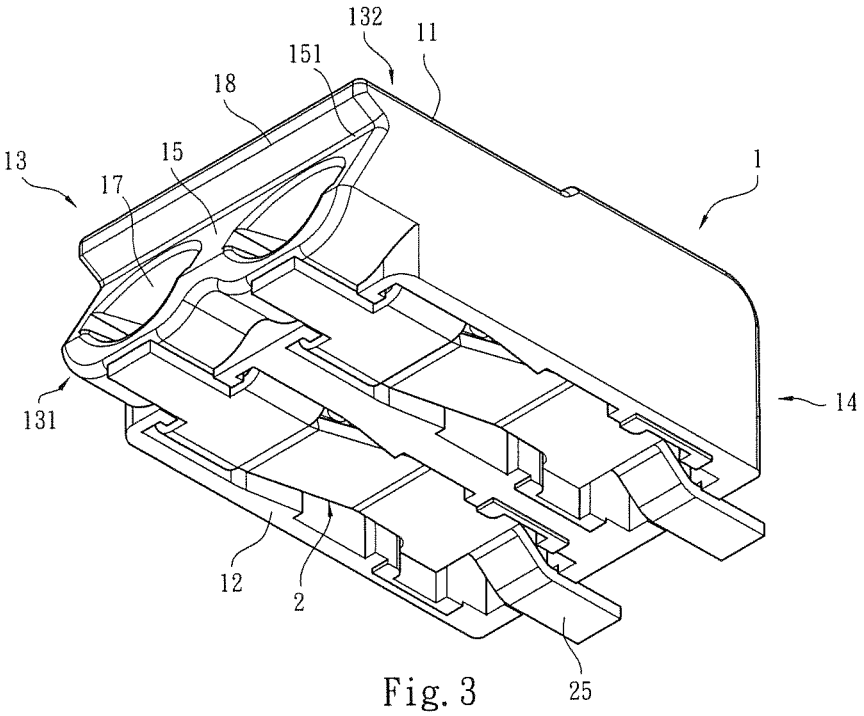
FIG. 3 is a bottom perspective view of the present invention according to FIG. 1.

Referring to FIGS. 2 and 3, the conductive clip 2 is made of a conductive metal plate by bending. The conductive clip 2 has two elastic holding arms 21, 23 for holding the conductive wire or the contact pin of an external electronic component. The conductive clip 2 further has at least one soldering leg 25 exposed to the bottom face 12 of the seat body 1. The soldering leg 25 of the seat body 1 can be soldered on an external circuit board. The two elastic holding arms 21, 23 of the conductive clip 2 define therebetween a holding mouth 20. Each of the two elastic holding arms 21, 23 of the conductive clip 2 is formed with a force application section 22, 24. The force application sections 22, 24 respectively protrude from the elastic holding arms 21, 23 and are bent to two sides. When the force application sections 22, 24 are driven by an external force, the elastic holding arms 21, 23 are urged to open/close the holding mouth 20.

Figure 4:
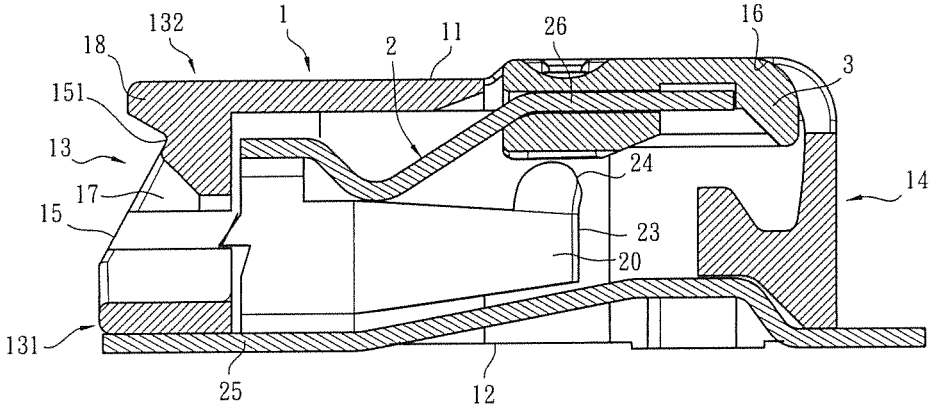
FIG. 4 is a sectional view of the present invention according to FIG. 1.

Please now refer to FIGS. 2 and 4. The top face 11 of the seat body 1 is formed with a perforation 16. A pushbutton 3 is disposed in the perforation 16 and separated from the seat body 1. To speak more specifically, the conductive clip 2 has an elastic extension arm 26 extending between the force application sections 22, 24. The pushbutton 3 is disposed on the elastic extension arm 26. When the pushbutton 3 is pressed by an external force, the pushbutton 3 can drive the force application sections 22, 24 of the conductive clip 2.

As shown in the drawings, in this embodiment, the slope 15 is formed with a wire plug-in opening 17 in alignment with the holding mouth 20. In addition, a wire plug-in protection wall 18 is formed on the edge 151 of the recessed side 132 of the slope 15. The wire plug-in protection wall 18 protrudes from the edge 151 in a direction as the extending direction of the extending side 131. Accordingly, the extending side 131 of the slope 15 and the wire plug-in protection wall 18 together define a recessed configuration on the front end 13 of the seat body 1. In a preferred embodiment, there are a multiplicity of conductive clips 2, wire plug-in openings 17, perforations 16 and pushbuttons 3. For example, a conductive clip 2 serves to electrically connect with the anode of the power supply, while another conductive clip 2 serves to electrically connect with the cathode of the power supply. The conductive clips 2 are side by side arranged in the seat body 1. The wire plug-in protection wall 18 extends along the edge 151 between two sides of the seat body 1 to provide protection and guiding effects on the same side of the wire plug-in openings 17.

Figure 5:
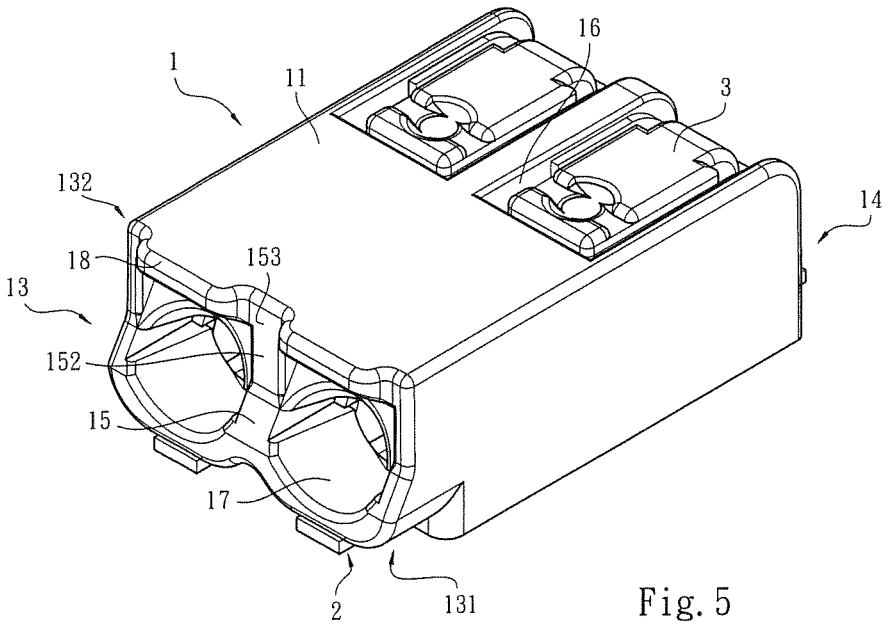
FIG. 5 is a perspective view of another embodiment of the present invention.

Alternatively, as shown in FIG. 5, in a second embodiment of the present invention, there are a multiplicity of conductive clips 2, wire plug-in openings 17, perforations 16, pushbuttons 3 and wire plug-in protection walls 18. Each wire plug-in opening 17 has a wire plug-in protection wall 18 formed on an outer edge of the wire plug-in opening 17. In addition, a middle partitioning wall 152 is formed between two adjacent wire plug-in openings 17. Also, a recessed section 153 is formed between two adjacent wire plug-in protection walls 18. The middle partitioning wall 152 is positioned between the recessed section 153 and the slope 15.

According to the above arrangement, when it is desired to quickly replace an internal circuit board or electronic component of an electronic product or apparatus in precondition that the electronic product or apparatus is not disassembled to a great extent, an operator can extend his hand into the electronic product or apparatus to touch and quickly find the wire plug-in protection wall 18 and immediately identify the position of the wire plug-in opening 17 of the seat body 1. Then, the operator can press the pushbutton 3 to drive the force application sections 22, 24 so as to open the holding mouth 20 of the conductive clip 2. Thereafter, the conductive wire or the contact pin of the original electronic component can be quickly extracted out of the wire plug-in opening 17.

Then, in a touch manner, the terminal of the conductive wire or the contact pin of the substitutive electronic component is quickly moved to a positioned nearby to the wire plug-in protection wall 18 of the seat body 1 and plugged into the seat body 1. The wire plug-in protection wall 18 on the outer edge of the wire plug-in opening 17 provides a shielding effect so that the terminal of the conductive wire or the contact pin of the substitutive electronic component can be very easily and quickly plugged into the wire plug-in opening 17.

During the period of operation, even if the terminal of the conductive wire or the contact pin of the substitutive electronic component is plugged onto the slope 15 by error, the slope 15 can still guide the terminal of the conductive wire or the contact pin to slide toward the wire plug-in protection wall 18. After the terminal of the conductive wire or the contact pin is slid to reach the wire plug-in opening 17, the terminal of the conductive wire or the contact pin can be easily plugged into the wire plug-in opening 17. Accordingly, the terminal of the conductive wire or the contact pin of the electronic component is prevented from slid away from the wire plug-in opening 17.

In addition, in the case that the terminal of the conductive wire or the contact pin of the electronic component is plugged into the wire plug-in opening 17 by an excessively large angle and the terminal of the conductive wire or the contact pin is pressed against the outer edge of the wire plug-in opening 17 to cause bending or twisting of the terminal of the conductive wire or the contact pin, the wire plug-in protection wall 18 serves to prevent the terminal of the conductive wire or the contact pin from being greatly deformed. Therefore, even if the terminal of the conductive wire or the contact pin is slightly bent, the terminal of the conductive wire or the contact pin can be still protected and guided to plug into the wire plug-in opening 17.

Accordingly, in the present invention, the upper and lower sides of the wire plug-in opening 17 of the seat body 1 provide shielding, protection and guiding effects for the terminal of the conductive wire or the contact pin to be plugged into the wire plug-in opening 17. This enables the terminal of the external conductive wire or the contact pin to be aimed at and plugged into the wire plug-in opening 17. Also, when plugged into the wire plug-in opening 17, the terminal of the conductive wire or the contact pin is prevented from being twisted or deviated from the wire plug-in opening 17. Therefore, the use of the wire connection terminal structure is facilitated. As aforesaid, the seat body of the conventional wire connection terminal generally has a rectangular and regular configuration. Therefore, it is hard for an operator to identify the position of the wire plug-in opening of the seat body by way of barehanded touch. Also, it is uneasy for the operator to aim the conductive wire or the contact pin of the electronic component at the wire plug-in opening of the seat body and plug the conductive wire or the contact pin into the wire plug-in opening. Therefore, it is inconvenient to use the conventional wire connection terminal. The present invention eliminates the above shortcomings of the conventional wire connection terminal.

The above embodiments are only used to illustrate the present invention, not intended to limit the scope thereof. Many modifications of the above embodiments can be made without departing from the spirit of the present invention.

What is claimed is:

1. A wire connection terminal structure comprising a seat body and a conductive clip disposed in the seat body, one end of the seat body having an extending side and a recessed side and a slope formed between the extending side and the recessed side, the conductive clip having a holding mouth, the slope being formed with a wire plug-in opening in alignment with the holding mouth, a wire plug-in protection wall being formed on an edge of the recessed side of the slope, the wire plug-in protection wall protruding from the edge in a direction as an extending direction of the extending side.

2. The wire connection terminal structure as claimed in claim 1, wherein the conductive clip has at least one soldering leg exposed to a bottom face of the seat body, the slope being connected between a top face and the bottom face of the seat body, the slope having an edge inclined to the other end of the seat body and connected with the top face of the seat body.

3. The wire connection terminal structure as claimed in claim 2, wherein the conductive clip has a force application section for driving the conductive clip to open/close the holding mouth, the top face of the seat body being formed with a perforation corresponding to the force application section, a pushbutton being disposed in the perforation for driving the force application section.

4. The wire connection terminal structure as claimed in claim 1, wherein there are a multiplicity of conductive clips and wire plug-in openings, the conductive clips being side by side arranged in the seat body, the wire plug-in protection wall extending between two sides of the seat body to provide protection and guiding effects on one side of each wire plug-in opening.

5. The wire connection terminal structure as claimed in claim 2, wherein there are a multiplicity of conductive clips and wire plug-in openings, the conductive clips being side by side arranged in the seat body, the wire plug-in protection wall extending between two sides of the seat body to provide protection and guiding effects on one side of each wire plug-in opening.

6. The wire connection terminal structure as claimed in claim 3, wherein there are a multiplicity of conductive clips, wire plug-in openings, perforations and pushbuttons, the conductive clips being side by side arranged in the seat body, the wire plug-in protection wall extending between two sides of the seat body to provide protection and guiding effects on the same side of the wire plug-in openings.

7. The wire connection terminal structure as claimed in claim 1, wherein there are a multiplicity of conductive clips, wire plug-in openings and wire plug-in protection walls, the conductive clips being side by side arranged in the seat body, a middle partitioning wall being formed between two adjacent wire plug-in openings, a recessed section being formed between two adjacent wire plug-in protection walls, the middle partitioning wall being positioned between the recessed section and the slope.

8. The wire connection terminal structure as claimed in claim 2, wherein there are a multiplicity of conductive clips, wire plug-in openings and wire plug-in protection walls, the conductive clips being side by side arranged in the seat body, a middle partitioning wall being formed between two adjacent wire plug-in openings, a recessed section being formed between two adjacent wire plug-in protection walls, the middle partitioning wall being positioned between the recessed section and the slope.

9. The wire connection terminal structure as claimed in claim 3, wherein there are a multiplicity of conductive clips, wire plug-in openings, perforations, pushbuttons and wire plug-in protection walls, the conductive clips being side by side arranged in the seat body, a middle partitioning wall being formed between two adjacent wire plug-in openings, a recessed section being formed between two adjacent wire plug-in protection walls, the middle partitioning wall being positioned between the recessed section and the slope.

* * * * *